US008016076B2

(12) United States Patent
Parker

(10) Patent No.: US 8,016,076 B2
(45) Date of Patent: Sep. 13, 2011

(54) FLIP LADDER WITH TRAY AND METHOD

(75) Inventor: Thomas W. Parker, Jamestown, PA (US)

(73) Assignee: Werner Co., Greenville, PA (US)

( * ) Notice: Subject to any disclaimer, the term of this patent is extended or adjusted under 35 U.S.C. 154(b) by 911 days.

(21) Appl. No.: 11/644,346

(22) Filed: Dec. 22, 2006

(65) Prior Publication Data

US 2008/0149421 A1 Jun. 26, 2008

(51) Int. Cl.
*E06C 5/32* (2006.01)

(52) U.S. Cl. ..... 182/129; 182/20; 182/22; 248/210; 248/238

(58) Field of Classification Search ..... 182/20, 182/22, 129, 230; 248/210, 238
See application file for complete search history.

(56) References Cited

U.S. PATENT DOCUMENTS 4,557,350 A * 12/1985 Wang ..... 182/33
4,648,481 A * 3/1987 Lee ..... 182/28
6,427,805 B1 * 8/2002 Gibson et al. ..... 182/165
6,550,579 B2 * 4/2003 Gibson et al. ..... 182/161
2002/0017430 A1 * 2/2002 Rosko ..... 182/129
2005/0056489 A1 * 3/2005 Walsh ..... 182/156

* cited by examiner

*Primary Examiner* — Katherine Mitchell
*Assistant Examiner* — Daniel Cahn
(74) *Attorney, Agent, or Firm* — Ansel M. Schwartz

(57) ABSTRACT

A climbing apparatus that rests on a surface includes a flip ladder that can move between a straight configuration and a stepladder configuration. The apparatus includes a tray having a plane attached to the flip ladder that moves with the flip ladder between the straight configuration where the tray plane is essentially parallel with the ladder in a stowed position and a stepladder configuration where the tray plane is essentially parallel with the surface in an open position. A method for climbing includes the steps of moving a flip ladder between a straight configuration and a stepladder configuration. There is the step of moving a tray having a plane attached to the flip ladder from a stowed position where the tray plane is essentially parallel with the ladder to an opened position where the tray plane is essentially parallel with the surface. There is the step of moving the flip ladder from the stepladder configuration to the straight configuration which causes the tray to move automatically into the stowed position.

5 Claims, 12 Drawing Sheets

FLIP LADDER WITH TRAY AND METHOD

FIELD OF THE INVENTION

The present invention is related to a flip ladder having a tray. More specifically, the present invention is related to a flip ladder having a tray which when in a stowed position, allows a user to climb or descend the flip ladder without any hindrance by the tray.

BACKGROUND OF THE INVENTION

One type of ladder is informally called a flip ladder. These ladders can be used like a stepladder which can stand erect by itself when in use or can be "flipped" open to form a straight ladder for use when leaned up against some surface such as a wall. One limitation of flip ladders today is the lack of a tray for paint cans, tools etc. to be used when the ladder is in the stepladder configuration. The purpose of this invention is to provide a flip ladder having a tray attached to the ladder for use in the stepladder configuration. In addition, a means is provided to positively stow the tray out of the way of the user when the ladder is used in a straight configuration.

BRIEF SUMMARY OF THE INVENTION

The present invention pertains to a climbing apparatus that rests on a surface. The apparatus comprises a flip ladder that can move between a straight configuration and a stepladder configuration. The apparatus comprises a tray having a plane attached to the flip ladder that moves with the flip ladder between the straight configuration where the tray plane is essentially parallel with the ladder in a stowed position and a stepladder configuration where the tray plane is essentially parallel with the surface in an open position.

The present invention pertains to a method for climbing. The method comprises the steps of moving a flip ladder between a straight configuration and a stepladder configuration. There is the step of moving a tray having a plane attached to the flip ladder from a stowed position where the tray plane is essentially parallel with the ladder to an opened position where the tray plane is essentially parallel with the surface. There is the step of moving the flip ladder from the stepladder configuration to the straight configuration which causes the tray to move automatically into the stowed position.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 10:
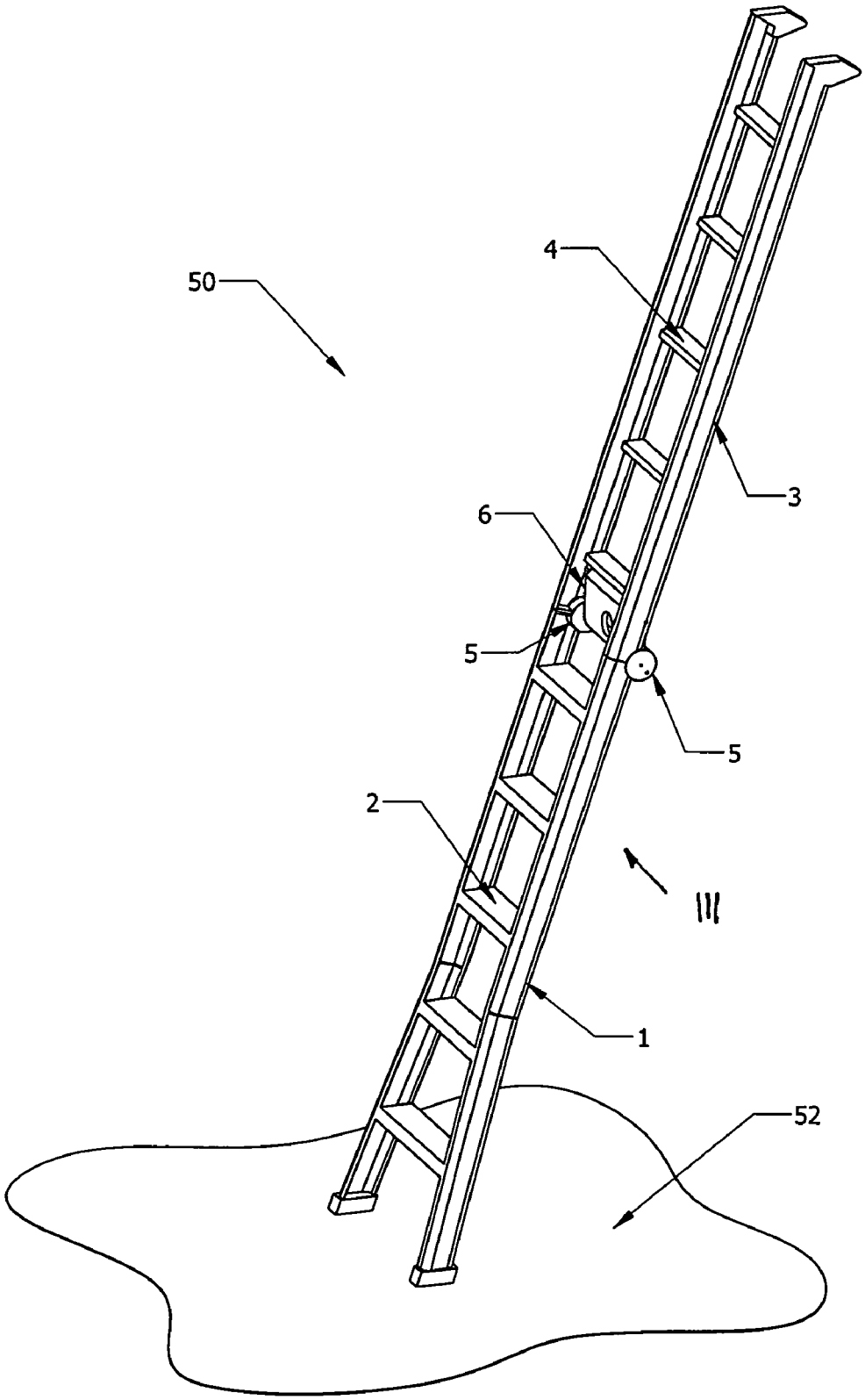
FIG. 10 is a perspective view of the ladder in the straight configuration.

Referring now to the drawings wherein like reference numerals refer to similar or identical parts throughout the several views, and more specifically to FIG. 10 thereof, there is shown a climbing apparatus 50 that rests on a surface 52. The apparatus 50 comprises a flip ladder 111 that can move between a straight configuration and a stepladder configuration. The apparatus 50 comprises a tray 6 having a plane 54 attached to the flip ladder 111 that moves with the flip ladder 111 between the straight configuration where the tray 6 plane 54 is essentially parallel with the ladder in a stowed position and a stepladder configuration where the tray 6 plane 54 is essentially parallel with the surface 52 in an open position.

Figure 1:
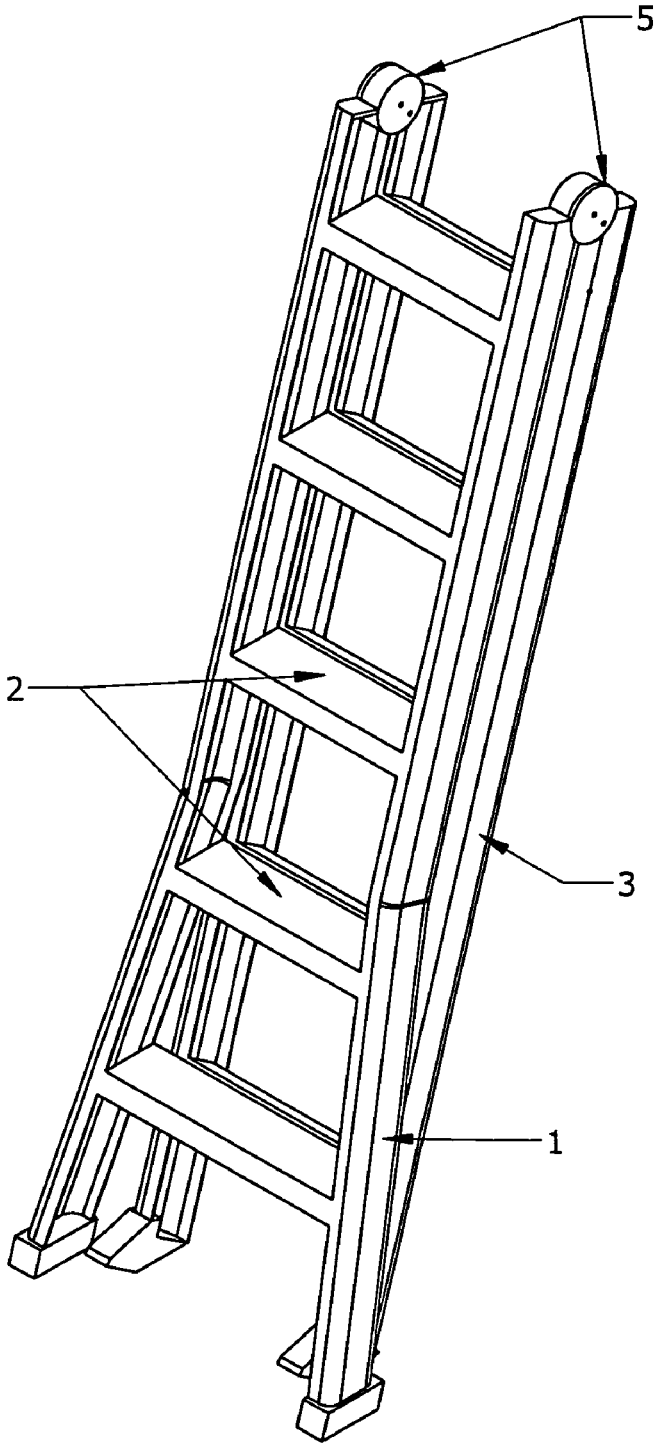
FIGS. 1, 2 and 3 show a flip ladder in a closed, a stepladder and straight configuration, respectively.
Figure 2:
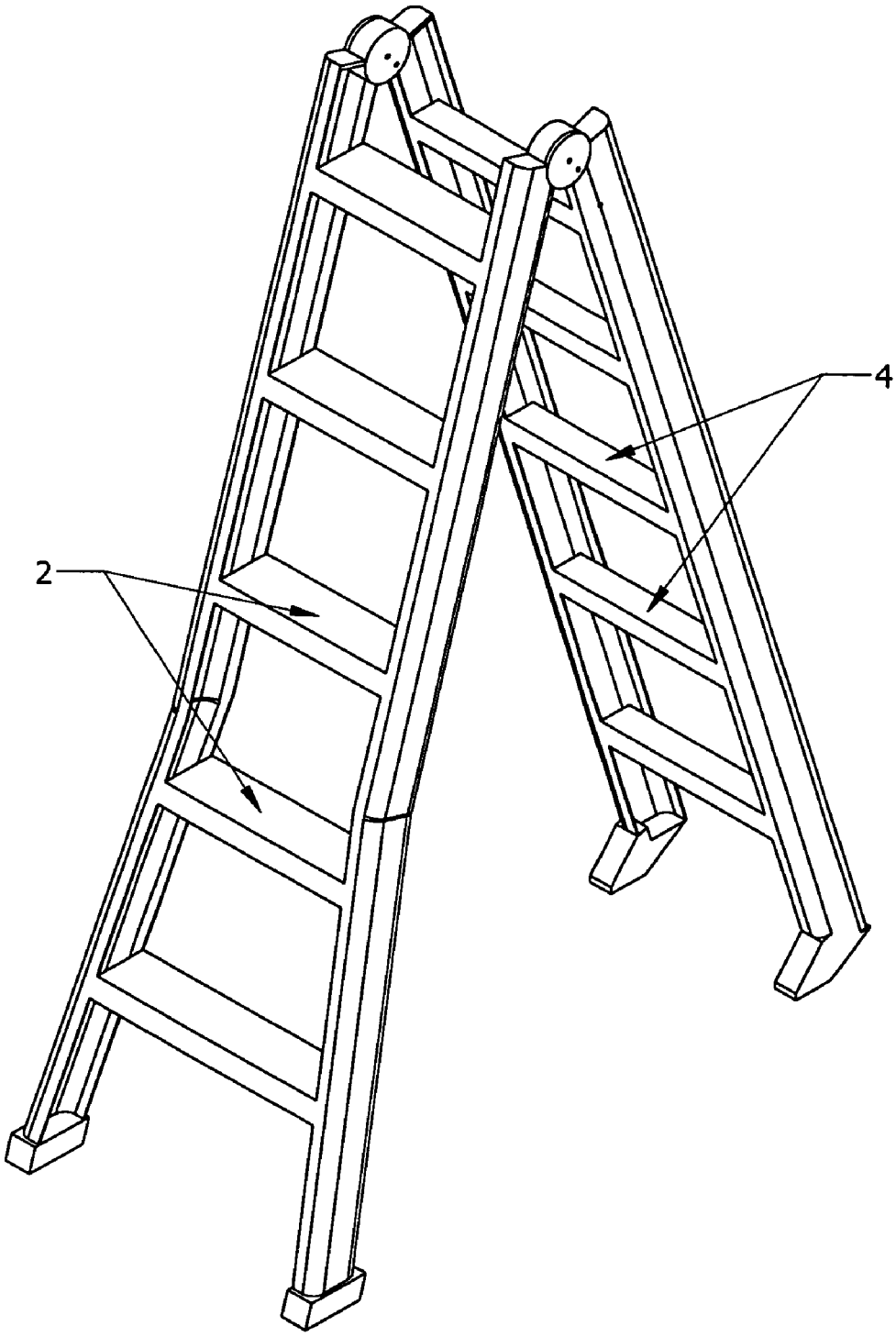
Figure 3:
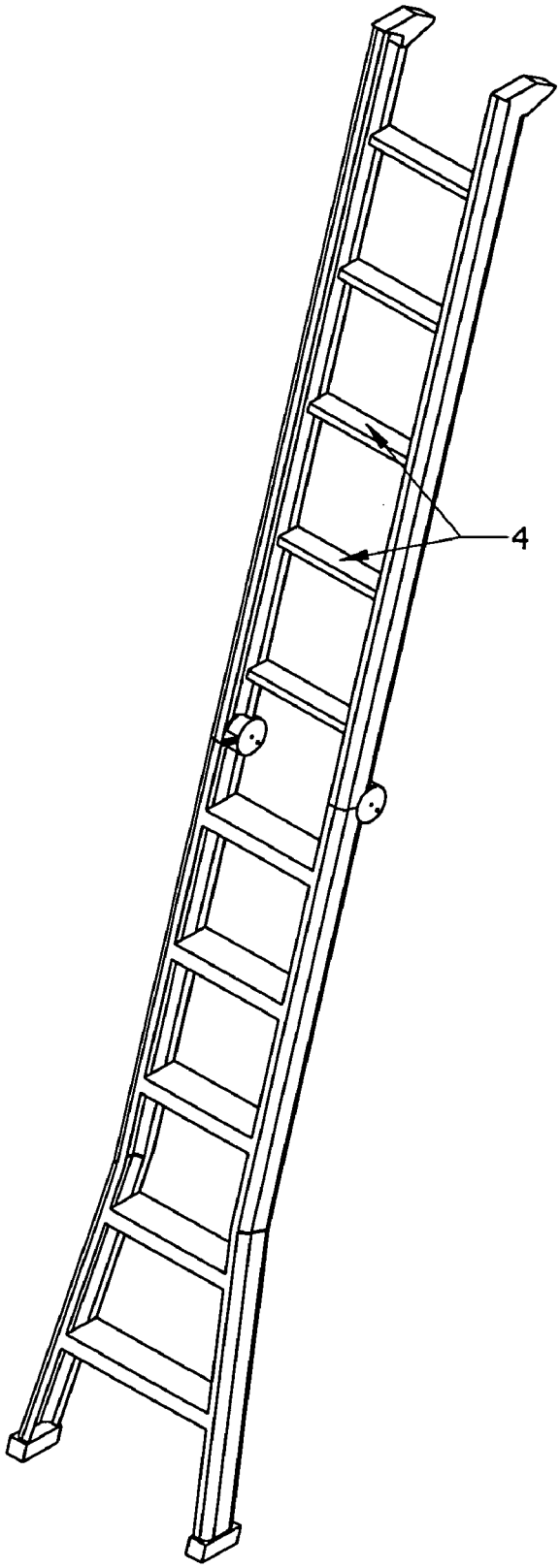

Preferably, the flip ladder 111 has a front section 1 having steps 2 and a rear upper section 3 having rungs 4, and hinges 5 which connect the front section 1 and rear upper section 3, as shown in FIGS. 1-3. The flip ladder 111 preferably can be locked in the stepladder configuration or the straight configuration. Preferably, the flip ladder 111 can be locked in the stepladder configuration or the straight configuration with the hinges 5. The rungs 4 on the rear upper section 3 are preferably double sided.

Preferably, the apparatus 50 includes a pivot rod 8 through which the tray 6 is attached to the rear upper section 3, as shown in FIGS. 4-7. The apparatus 50 preferably includes two tray links 7 through which at one end of each tray link 7 the tray 6 is pivotally attached at link pivots 9, and the other end of each tray link 7 is attached to a respective hinge. Preferably, the apparatus 50 includes studs 10 and wherein each tray link 7 has a slot, and the tray links 7 are connected to the hinges 5 through the studs 10 extending through the slots 11. The slots 11 preferably allow the links to pivot and slide relative to the front section 1.

Preferably, the tray 6 has a fully open position where the tray 6 rests on top of a highest rung of the rungs 4 of the front section 1. The tray 6 preferably has projections 13, and the tray 6 has a fully stored position where the projections 13 rest against a highest rung 12 of the rungs 4 of the rear upper section 3.

Figure 12:
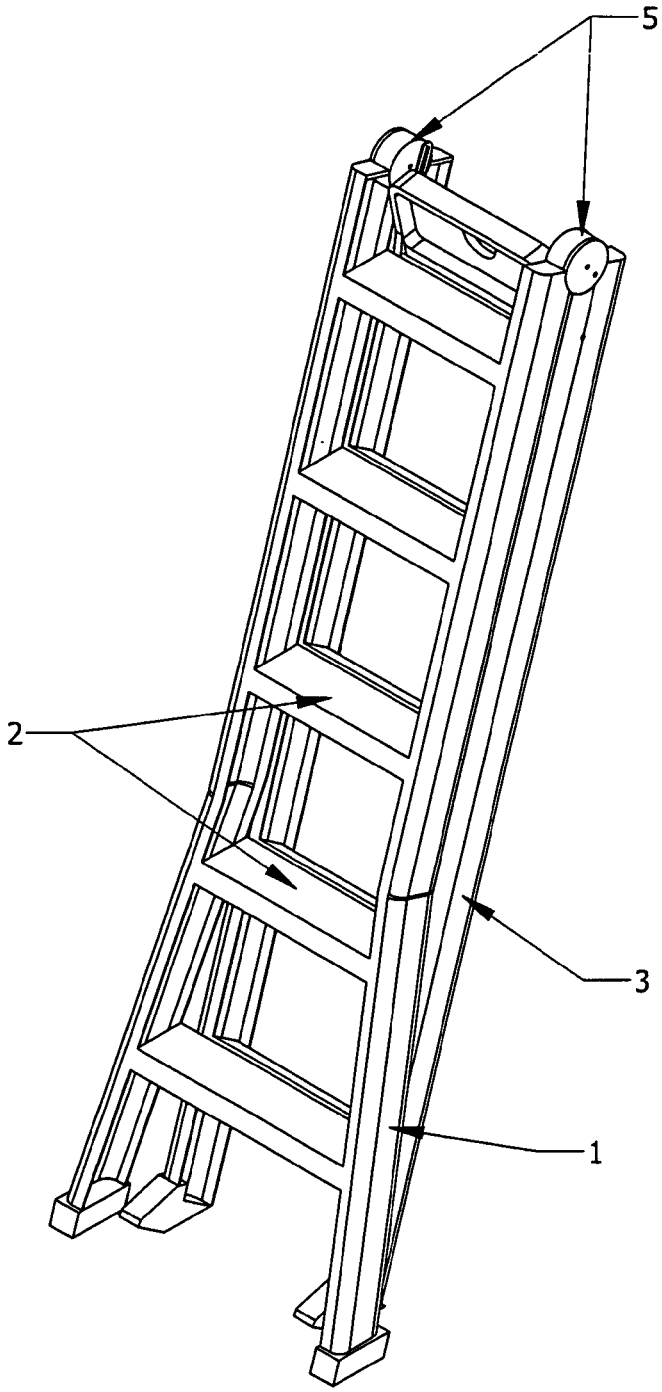
FIG. 12 shows the flip ladder with tray in the closed configuration.

Preferably, the flip ladder 111 has a closed configuration, as shown in FIG. 12, where the front section 1 and the rear upper section 3 are adjacent alongside each other and wherein the tray 6 can be moved freely between the opened and stowed positions when the ladder is in either the closed or stepladder configurations.

The slots 11 and the tray links 7 preferably prevent the tray links 7 from interfering with a motion of the tray 6. Preferably, the opening of the ladder from the closed to the stepladder to the straight configuration does not cause the tray 6 to move from the stowed to the open position. When the tray 6 is in the open position as the flip ladder 111 is moved from the stepladder to the straight configuration, the tray links 7 preferably force the tray 6 to move to the stowed position. Preferably, when the tray 6 is in the stowed position, a user is able to climb or descend the flip ladder 111 without any hindrance by the tray 6. The tray 6 and tray plane 54 are disposed between and inside a right rear rail 73 and a left rear rail 75 of the rear upper section 3 when the flu ladder 111 is in the straight configuration and the tray 6 is in the stowed position so the twoed tray 6 allows the user to climb or descend the ladder 111 without hindrance. When the flip ladder 111 is in the stepladder configuration and resting on the surface 52, the front section 1 and the right and left rear rails of the rear upper section 3 contact the surface 52.

The present invention pertains to a method for climbing. The method comprises the steps of moving a flip ladder 111 between a straight configuration and a stepladder configuration. There is the step of moving a tray 6 having a plane 54 attached to the flip ladder 111 from a stowed position where the tray 6 plane 54 is essentially parallel with the ladder to an opened position where the tray 6 plane 54 is essentially parallel with the surface 52. There is the step of moving the flip ladder 111 from the stepladder configuration to the straight configuration which causes the tray 6 to move automatically into the stowed position.

Preferably, there is the step of opening the ladder from a closed configuration to the stepladder configuration to the straight configuration does not cause the tray 6 to move from the stowed to the open position. There is preferably the step of locking the ladder in the stepladder configuration.

Preferably, there is the step of sliding tray links 7, pivotally attached to the tray 6 at link pivots 9 and to hinges 5 which connect a front section 1 and a rear upper section 3 of the flip ladder 111, relative to the front section 1 through slots 11 of the tray links 7.

In the operation of the preferred embodiment, a simplified flip ladder 111 is shown in FIGS. 1, 2 and 3 in the "closed", "stepladder" and "straight" configurations respectively. The ladder is composed of a front section 1 having steps 2, a rear/upper section 3 having rungs 4, and hinges 5 which connect the front and rear sections together. The hinges are made so that the flip ladder 111 can be securely locked into the stepladder and straight configurations, and unlocked to allow the ladder to be freely moved to any of the three configurations. The rungs on the rear/upper section are double-sided so that the user may climb that section when the ladder is in the stepladder configuration and also climb that section when the ladder is in the straight configuration.

Figure 4:
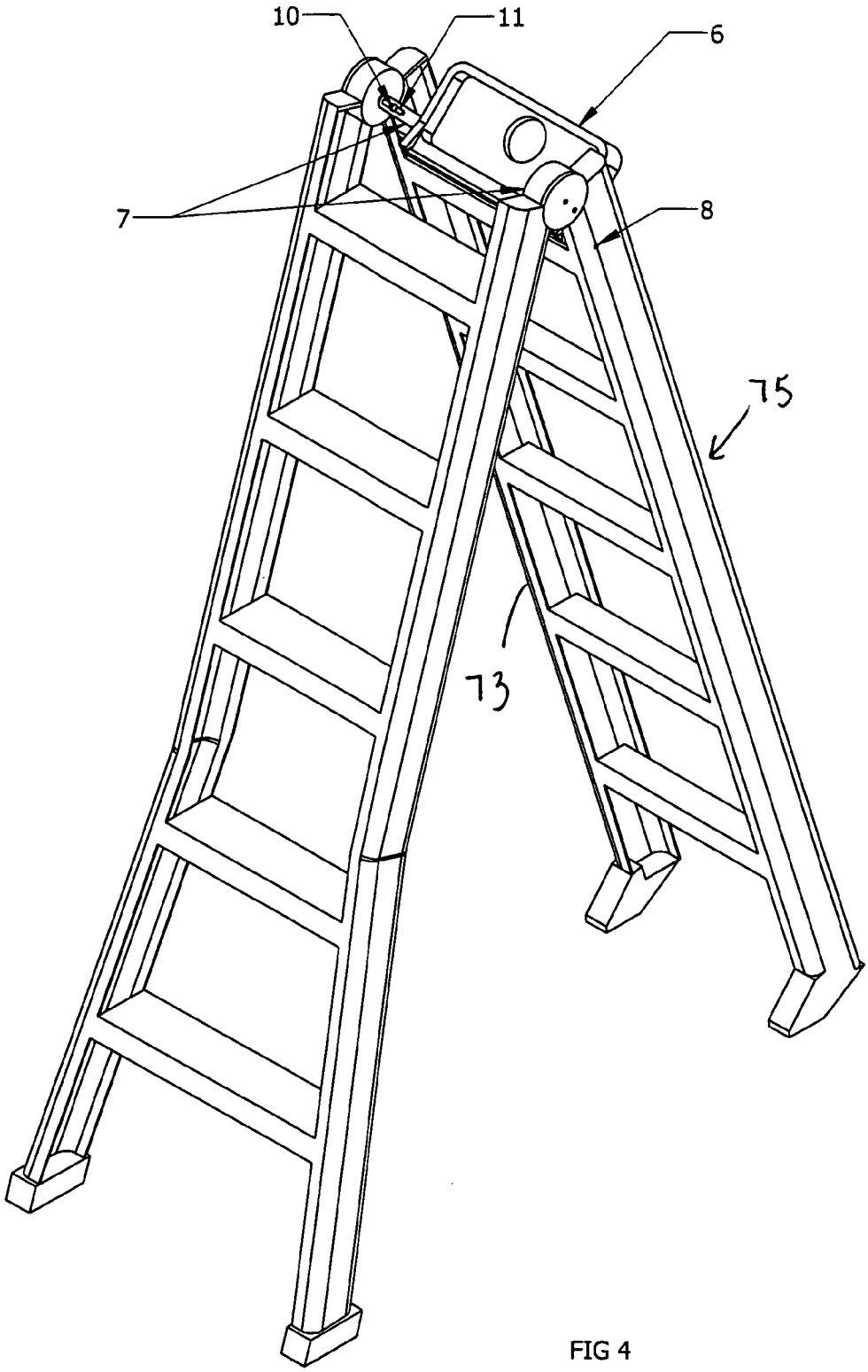
FIG. 4 shows a flip ladder of the present invention with a tray and two tray links.

FIG. 4 shows the ladder with the addition of a tray 6 and two tray links 7. The tray is shown halfway between the open and stowed positions. The tray is pivotally attached to the rear/upper section with a pivot rod 8. The tray links at one end are pivotally attached to the tray at the link pivots 9. The other end of the links are connected to the part of the hinge which is fastened to the front section by means of studs 10 through the slots 11 of the tray links. These slots allow the tray links to pivot and slide relative to the front section. These items can be seen more clearly in FIG. 5.

Figure 5:
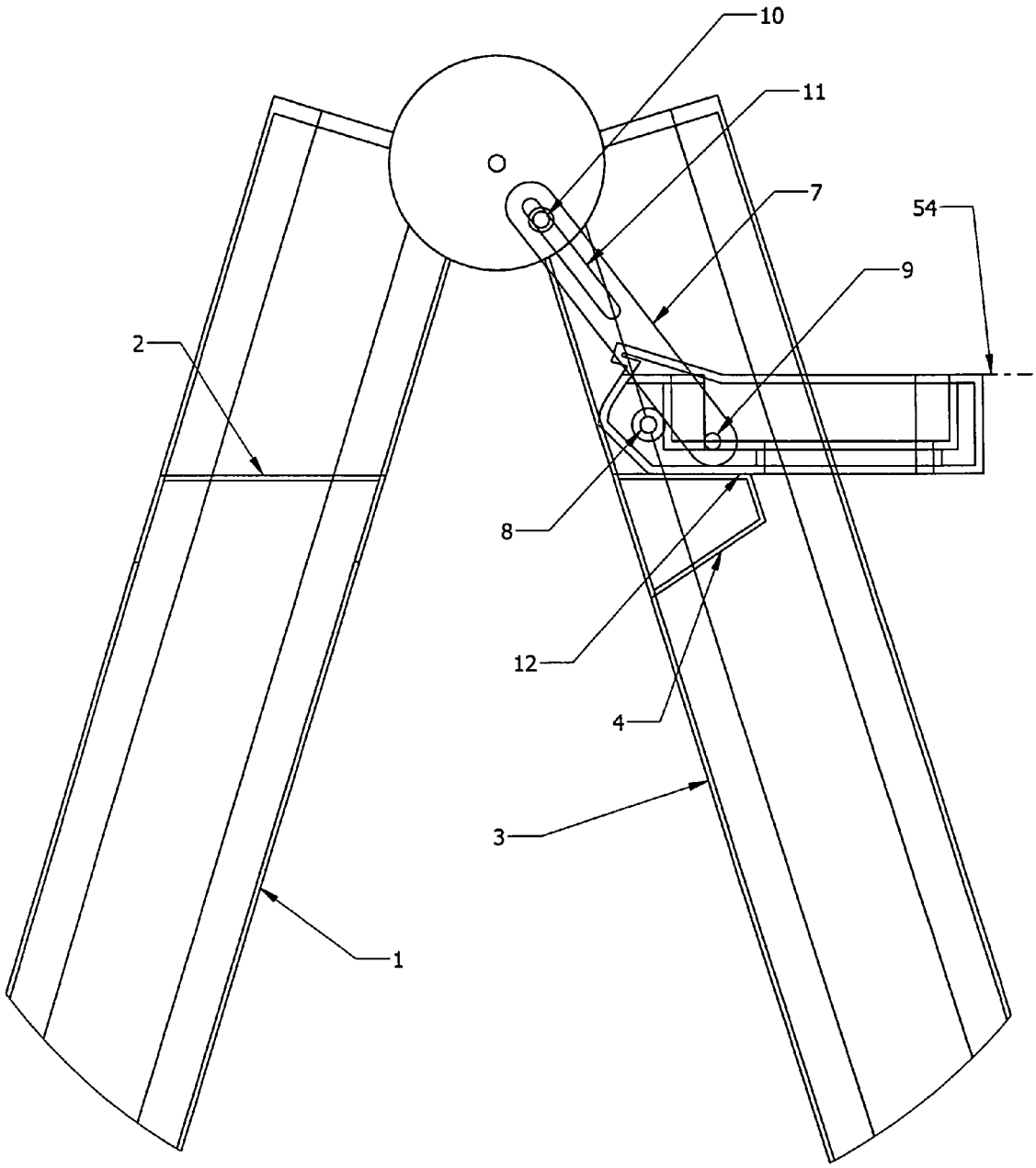
FIG. 5 shows the tray in a fully open position.

FIG. 5 shows the tray in the fully open position. In this position, the tray rests solidly on top of the highest rung 12 of the rear/upper section.

Figure 6:
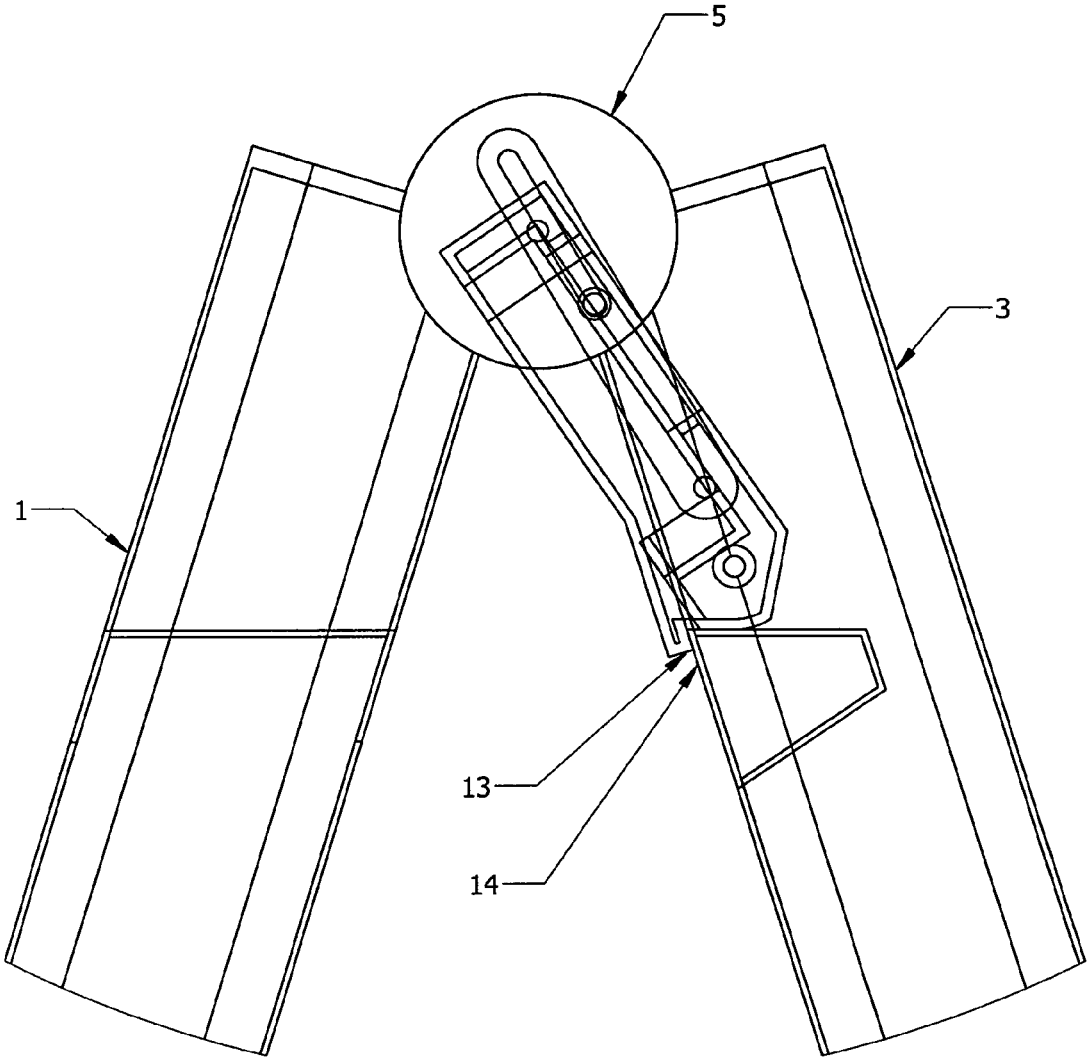
FIG. 6 shows the tray in a fully stowed position.

FIG. 6 shows the tray in the fully stowed position. In this position projections 13 on the tray rest against one face 14 of the highest rung of the rear/upper section.

The tray can be moved freely between the open and stowed positions when the ladder is in either the closed or stepladder configurations. The slots in the tray links prevent the tray links from interfering with the motion of the tray.

Also, at no time does the opening of the ladder from the closed to the stepladder to the straight configuration cause the tray to move from the stowed to the open position.

However, if the tray is in the open position as the ladder is moved from the stepladder to the straight configuration the tray links will force the tray to move to the stowed position as will be shown.

Figure 7:
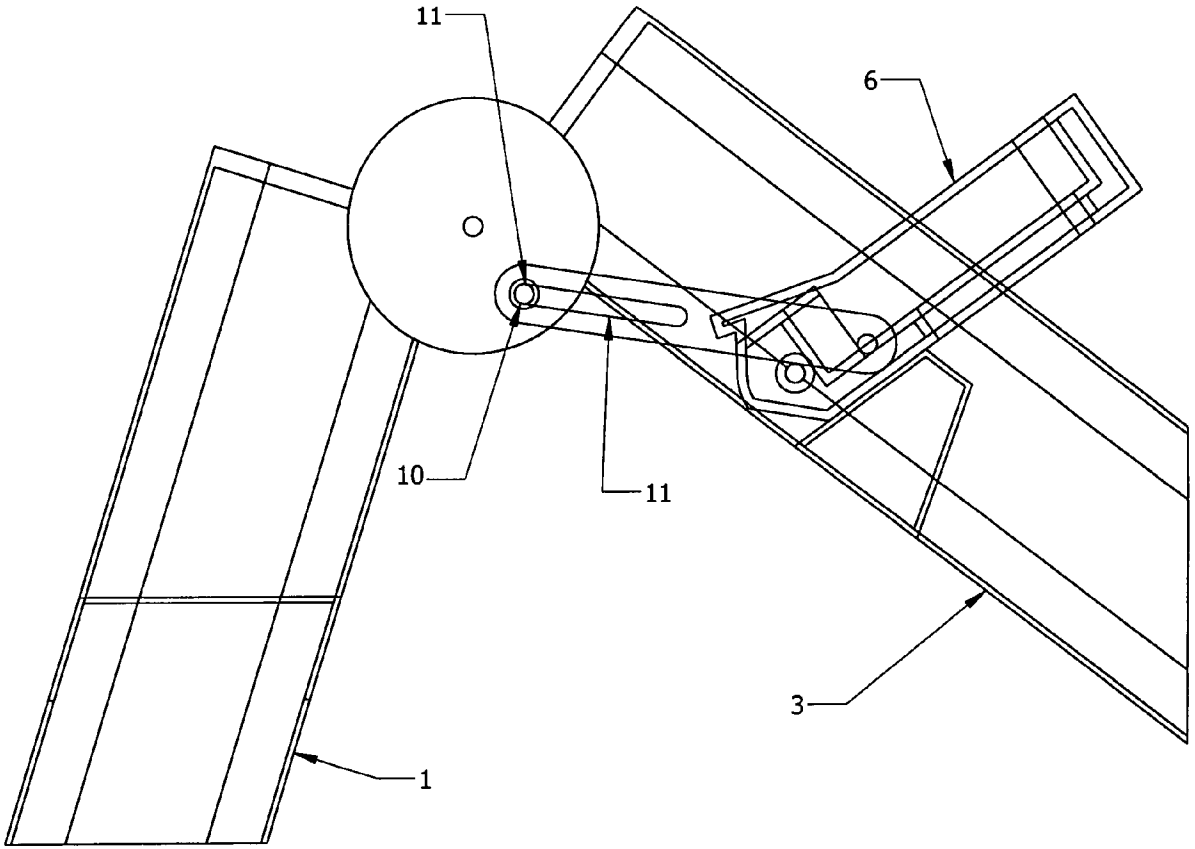
FIG. 7 shows the ladder as it is beginning to be moved from the stepladder configuration and tray open condition to the straight configuration.

FIG. 7 shows the ladder as it is beginning to be moved from the stepladder configuration and tray open condition of FIG. 5 to the straight configuration. Notice that due to the relative motion of the rear/upper section the studs attached to the front section have reached the end of the slots 11 in the tray links. From this point, the tray links pivot the tray toward the stowed position as the ladder continues to move toward the straight configuration.

Figure 8:
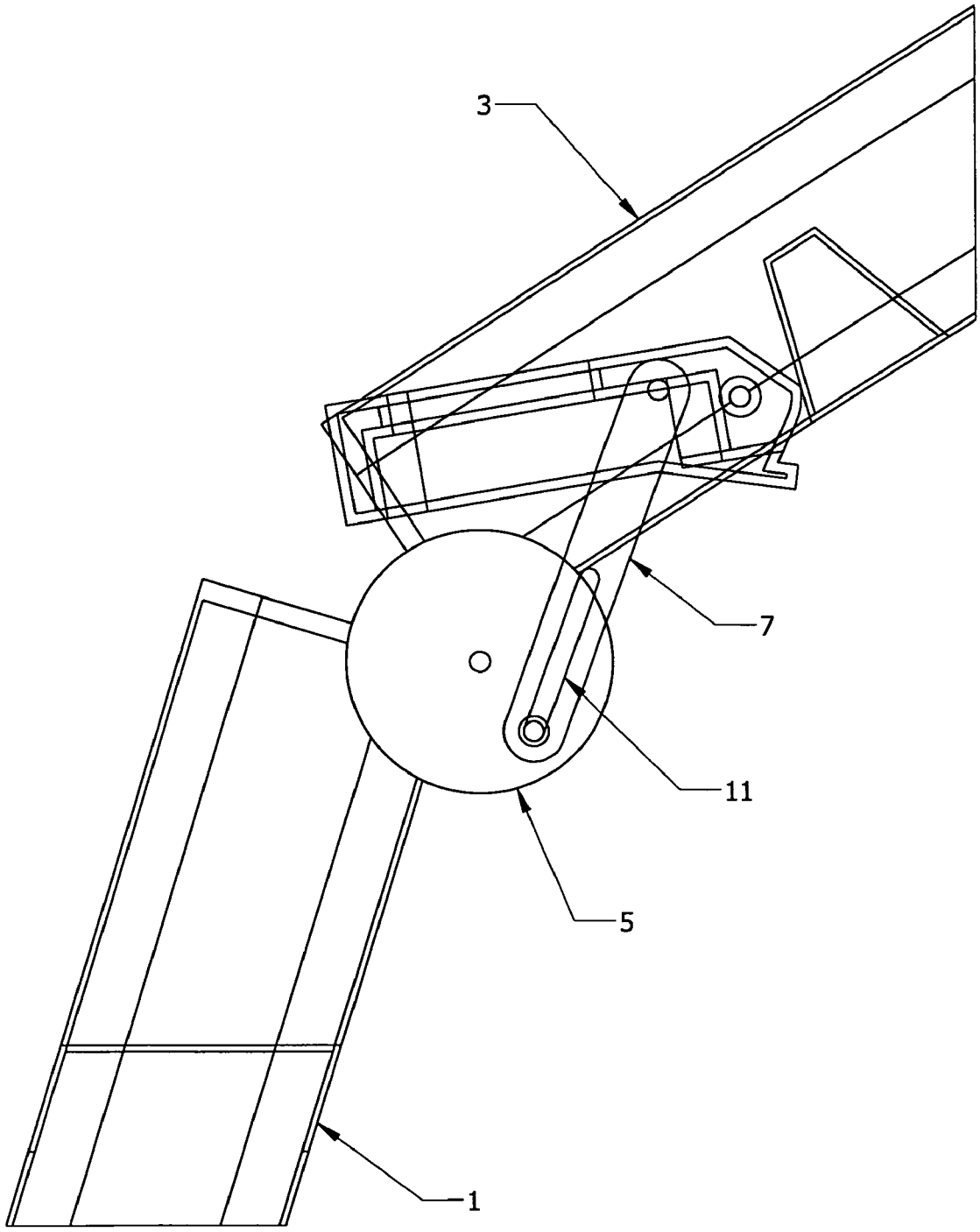
FIG. 8 shows the ladder as it approaches the straight configuration.

FIG. 8 shows the ladder as it approaches the straight configuration.

Figure 9:
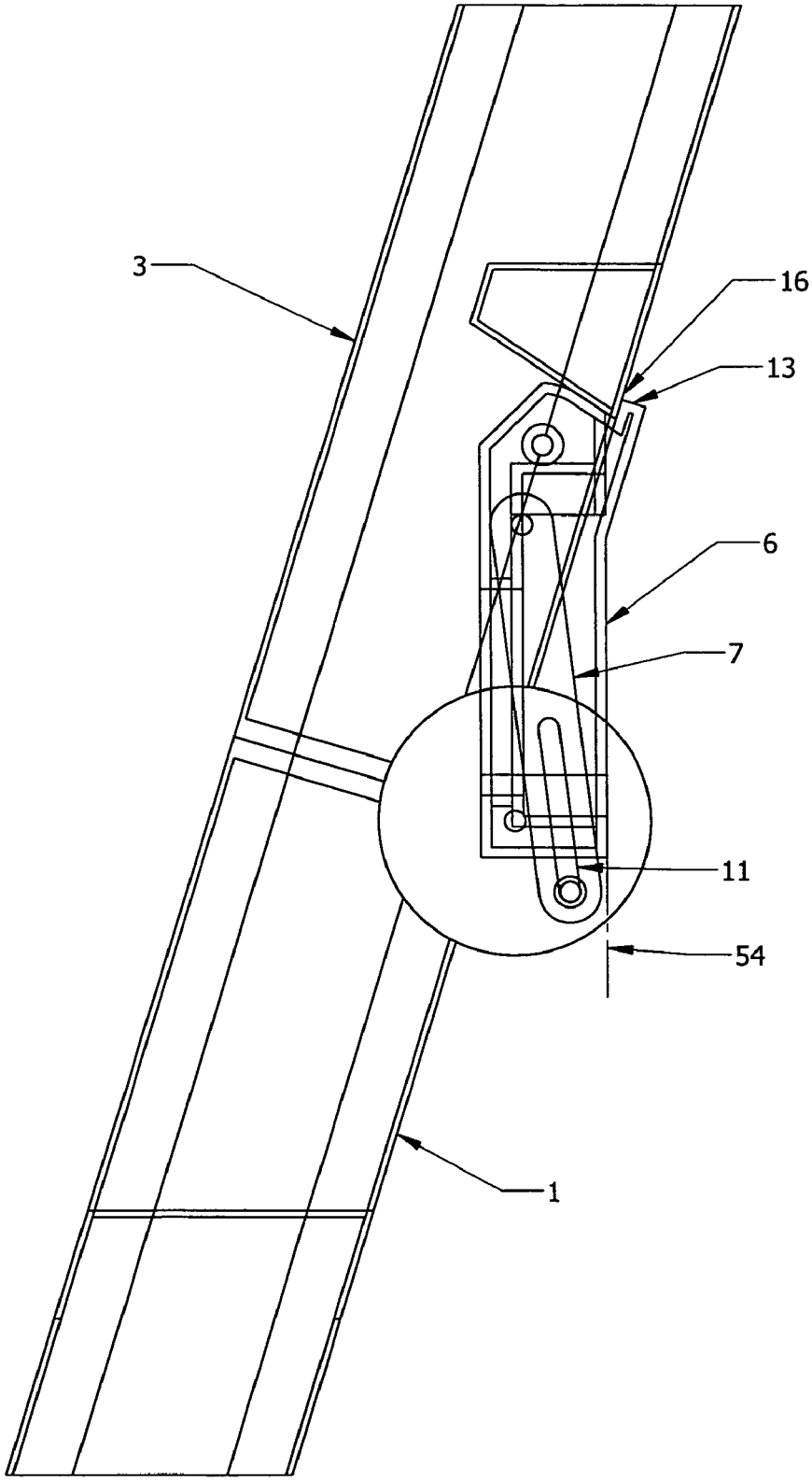
FIG. 9 shows a ladder in the straight configuration.

FIG. 9 shows the ladder in the straight configuration. The tray links have caused the tray to pivot until the projections 13 have contacted the face of the rung 16 and the tray is fully stowed. The tray cannot be moved from the stowed position while the ladder is straight.

FIG. 10 is an additional view of the ladder in the straight configuration. Notice that the stowed tray allows the user to climb or descend the ladder without any hindrance.

Figure 11:
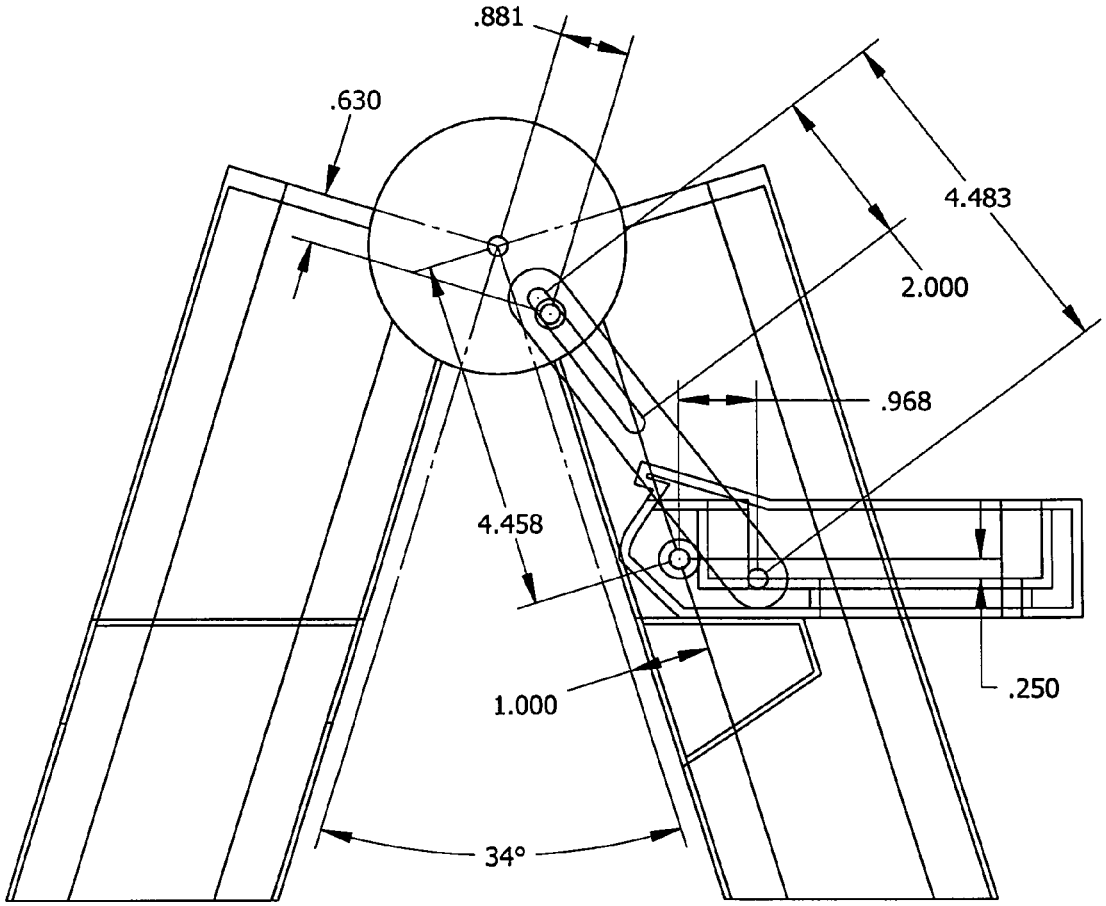
FIG. 11 shows the locations of key pivot points and the dimensions of the links of the present invention.

FIG. 11 shows the locations of key pivot points and the dimensions of the links of the present invention. The dimensions are preferred, but for exemplary purposes. The relationships of the elements are shown in regard to the dimensions, and these relationships can be used to vary the size of the flip ladder 111 in regard to the preferred embodiment, as desired.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A climbing apparatus that rests on a surface comprising:

a flip ladder that can move between a straight configuration, a stepladder and a closed configuration; and a tray defining a plane, the tray being attached to the flip ladder and moveable between a stowed position and an open position, the tray automatically and simultaneously pivots from the open position to the stowed position when the ladder pivots from the step ladder configuration to the straight configuration so that the tray is in the stowed position while the flip ladder is in the straight configuration and the tray is in the open position while the flip ladder is in the step ladder configuration, the tray and tray plane are essentially parallel with a major length of the flip ladder in the stowed position, and the tray and tray plane are essentially parallel to the surface when in the open position while the ladder is in the step ladder configuration; and the flip ladder has a front section having steps, a rear upper section having rungs, hinges directly connecting the front section and rear upper section, and a pivot rod that extends through the tray and pivotally attaches the tray to the rear upper section, the tray is disposed within a right rear rail and a left rear rail of the rear upper section while the flip ladder is in the straight configuration so as to allow a user to climb or descend the ladder without hindrance from the tray, and when the flip ladder is in the stepladder configuration it rests on the surface so that the front section and the right and left rear rails of the rear upper section contact the surface; and the flip ladder can be locked in the stepladder configuration and the flip ladder can be locked in the straight configuration with the hinges, and the rungs on the rear upper section are doubled sided, and two tray links, through which at a first end of each tray link, respectively, the tray is pivotally attached at respective link pivots, and a second end of each tray link, respectively, is attached to a respective hinge of the hinges, and studs, wherein each respective tray link has a respective slot, and the tray links are connected to the hinges respectively through a respective stud of the studs which extend within the slots respectively, the slots allow the links to pivot and slide relative to the front section, and when the tray is in the open position it directly rests on top of a highest rung of the rungs of the rear upper section, and when the tray is in the stowed position, projections of the tray directly rest against the highest rung.

2. An apparatus as described in claim 1 wherein the closed configuration occurs when the front section and the rear upper section are adjacent alongside each other.

3. An apparatus as described in claim 2 wherein the slots and the tray links prevent the tray links from interfering with a motion of the tray.

4. An apparatus as described in claim 3 wherein opening of the ladder from the closed to the stepladder to the straight configuration does not cause the tray to move from the stowed to the open position.

5. An apparatus as described in claim 4 wherein when the tray is in the open position as the flip ladder is moved from the stepladder to the straight configuration, the tray links force the tray to move to the stowed position.

* * * * *